US007431417B2

(12) United States Patent
Rodenas et al.

(10) Patent No.: US 7,431,417 B2
(45) Date of Patent: Oct. 7, 2008

(54) INK DENSITY IMPACT ON SENSOR SIGNAL-TO-NOISE RATIO

(75) Inventors: Josep Antoni Rodenas, Barcelona (ES); Marc Serra, Barcelona (ES); David Gaston, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 498 days.

(21) Appl. No.: 10/974,066

(22) Filed: Oct. 27, 2004

(65) Prior Publication Data

US 2006/0087528 A1 Apr. 27, 2006

(51) Int. Cl.
*B41J 29/393* (2006.01)

(52) U.S. Cl. ..... 347/19

(58) Field of Classification Search ..... 347/19, 347/5, 6, 7, 15; 358/3.01, 3.06, 3.1, 3.3, 358/534, 504

See application file for complete search history.

(56) References Cited

U.S. PATENT DOCUMENTS 5,835,108 A 11/1998 Beauchamp et al.
6,196,652 B1 * 3/2001 Subirada et al. ..... 347/19
6,198,549 B1 * 3/2001 Decker et al. ..... 358/504
6,361,139 B1 * 3/2002 Gomez et al. ..... 347/19
6,561,613 B2 * 5/2003 Cunnagin et al. ..... 347/19
6,690,471 B2 * 2/2004 Tandon et al. ..... 356/420
6,714,748 B1 * 3/2004 Nakayasu et al. ..... 399/72
6,832,824 B1 * 12/2004 Baker et al. ..... 347/19
6,871,931 B2 * 3/2005 Kaneko ..... 347/19
6,876,467 B1 * 4/2005 Yamaguchi ..... 358/1.9
7,044,573 B2 * 5/2006 King et al. ..... 347/19
2002/0181986 A1 12/2002 Castano et al.
2003/0020972 A1 * 1/2003 Subirada et al. ..... 358/518
2003/0081037 A1 * 5/2003 Gaston et al. ..... 347/19
2003/0210412 A1 * 11/2003 Ishibashi ..... 358/1.9

* cited by examiner

*Primary Examiner*—Stephen D. Meier
*Assistant Examiner*—Rene Garcia, Jr.

(57) ABSTRACT

A printer is configured to manage a signal-to-noise ratio of a signal produced by a sensor scanning a print test pattern. The print test pattern is printed while controlling ink density printed by each of one or more pens. Each ink density is selected so that the signal-to-noise ratio exceeds a threshold as the print test pattern is scanned. Pens within the printer are aligned or otherwise maintained by adjusting nozzle firings as indicated by data obtained from the signal during the scanning.

23 Claims, 4 Drawing Sheets

INK DENSITY IMPACT ON SENSOR SIGNAL-TO-NOISE RATIO

TECHNICAL FIELD

This disclosure relates to ink densities and their impact on sensors within an inkjet printer, and more particularly to the use of the ink density with which test and/or alignment patterns are printed as a means to vary a sensor's signal-to-noise ratio during various processes, such as when inkjet pens are aligned.

BACKGROUND

Inkjet printers typically use one or more "pens." In many applications, each pen includes an ink reservoir and a nozzle orifice plate from which ink is discharged. Such pens are typically user-replaceable, having been configured to simply "snap" in or out of the carriage of the inkjet printer.

In many such printers, tolerances between the pen and the carriage, tolerances in the nozzles of the orifice plate and other factors, individually and in combination, direct ink drops in unexpected directions from one or more nozzle openings to the print media. This can result in reduced image quality. However, in many cases compensation may be made for the factors which result in image quality reduction.

In particular, it is known that a "test pattern" or "alignment pattern" may be printed. A sensor may then be used to scan the alignment pattern to gather data. An algorithm may then be used to compare data obtained from scanning the alignment pattern as printed (with possible image quality problems due to pen alignment errors) to theoretical data representing scanning of a correctly printed alignment pattern. Having made the comparison, the algorithm may then calculate a mapping by which input provided to the pens of the printer may be altered to result in the desired output.

A problem is frequently encountered by the sensor when scanning the alignment pattern. In particular, an output of the sensor may have a low signal-to-noise ratio. This problem has been addressed by several proposed solutions. In a first proposed solution, the width of patches of ink contained within the alignment pattern may be increased. The increased width frequently increases the signal-to-noise ratio of the output of the sensor.

A second proposed solution involves selecting LEDs (light emitting diodes) which best illuminate the print alignment pattern during scanning. In particular, LEDs having a spectra (i.e. a frequency of emitted light) that is better suited for use with ink colors used in the print alignment pattern may be selected. Where compatible, the LED color and ink colors combine to increase the signal-to-noise ratio of the output of the sensor.

A third proposed solution is that more than one LED be used to illuminate the alignment pattern as it is scanned by the sensor. Properly balanced, such an LED system can increase the signal-to-noise ratio of the output of the sensor.

Each of the above solutions to the problem of a low signal-to-noise ratio has problems that limit effectiveness and increase cost. A more effective solution to this problem would lower printer cost, increase image quality and provide other advantages.

SUMMARY

A printer is configured to manage a signal-to-noise ratio of a signal produced by a sensor scanning a print test pattern. The print test pattern is printed while controlling ink density printed by each of one or more pens. Each ink density is selected so that the signal-to-noise ratio exceeds a threshold as the print test pattern is scanned. Pens within the printer are aligned or otherwise maintained by adjusting nozzle firings as indicated by data obtained from the signal during the scanning.

BRIEF DESCRIPTION OF THE DRAWINGS

The following detailed description refers to the accompanying figures. In the figures, the left-most digit(s) of a reference number identifies the figure (Fig.) in which the reference number first appears. Moreover, the same reference numbers are used throughout the drawings to reference like features and components.

DETAILED DESCRIPTION

A printer 100 is configured to manage a signal-to-noise ratio of a signal produced by a sensor scanning a print alignment pattern. The print alignment pattern, having at least two colors, is printed while controlling ink density of ink of each color printed. Each ink density is selected so that the signal-to-noise ratio exceeds a threshold as the print alignment pattern is scanned. Pens within the printer are aligned by adjusting nozzle firings of misaligned pens as indicated by data obtained from the signal during the scanning.

Figure 1:
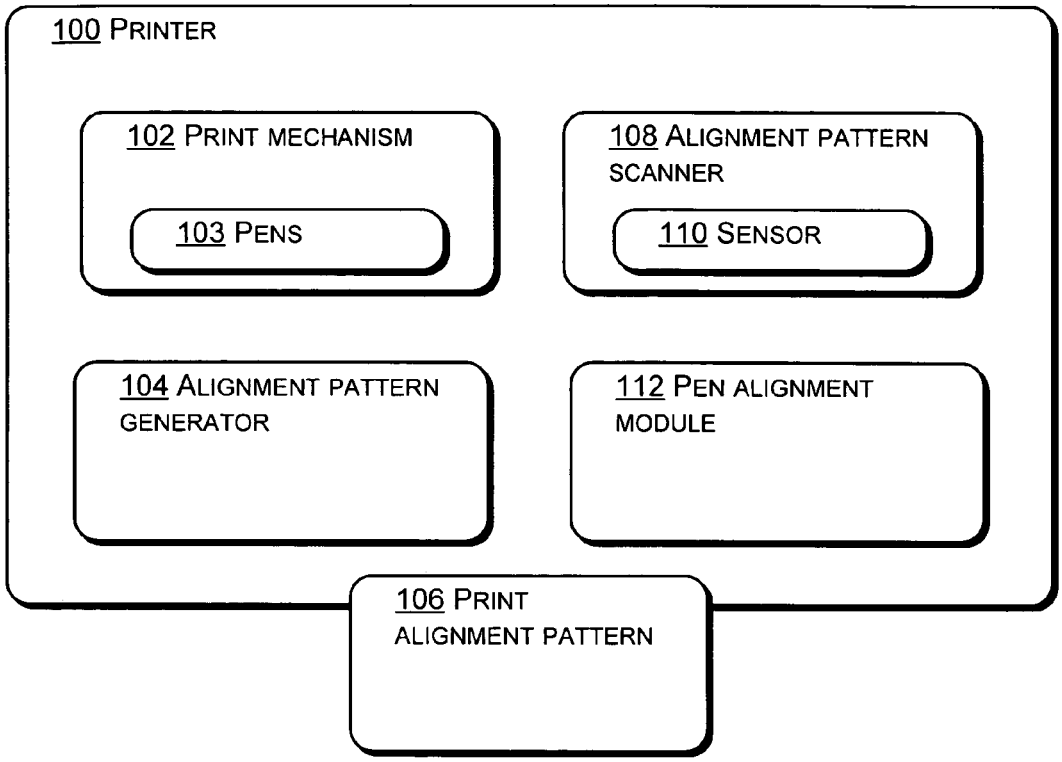
FIG. 1 is a block diagram of an exemplary printer adapted to use ink density with which alignment patterns are printed to vary a scanning sensor's signal-to-noise ratio during a process by which inkjet pens are aligned.

FIG. 1 is a block diagram showing one example of a printer 100 that is adapted to print and use a print test pattern. The test pattern may include one or more colors (e.g. black, cyan, magenta, etc.). In one example, the test pattern may be configured as an alignment pattern formed with two or more different ink colors, each of which may have been printed using a different ink density. Such an alignment pattern is adapted for use in aligning two or more pens. A print mechanism 102 within the printer 100 may be configured using inkjet technology, e.g. a technology wherein ink is exhausted from a plurality of nozzles within a nozzle orifice plate. A typical inkjet print mechanism 102 includes several "pens," i.e. typically user-replaceable print cartridges which include an ink reservoir and nozzle jets. In a typical application, several pens 103 are included within the printer, including pens for use with cyan, magenta, yellow and black inks. Additional pens 103 including light cyan and light magenta ink may also be included. After one or more pens 103 are installed, the pens must be aligned with each other, i.e. adjustments must be made so that ink discharged from each pen is properly located on print media with respect to ink discharged from other pens. The adjustments may include mapping of the input to one or more pens so that the mapped input results in the desired output.

An alignment pattern generator 104 is configured to direct, such as by forming appropriate signals or other means as required, the print mechanism 102 to create a print alignment pattern 106. The alignment pattern generator 104 is particularly configured to set an ink density with which each ink color used in the alignment pattern is printed. Such an ink density typically results in the signal-to-noise ratio of the signal of the sensor exceeding a threshold during scanning of the print alignment pattern 106.

The print alignment pattern 106 is printed by the print mechanism 102 at the direction of the alignment pattern generator 104. In a typical example, resulting from the direction of the alignment pattern generator 104, the print alignment pattern 106 will have patches of several different colors of ink. In particular, patches of different color may also have different ink densities. For example, light cyan and light magenta ink may have two or more times the ink density of cyan and magenta ink. By controlling the ink density of patches of different colors, the signal-to-noise ratio of a sensor scanning the differently colored patches may be kept above a threshold required for reliable data recovery from the sensor's signal.

Figure 2:
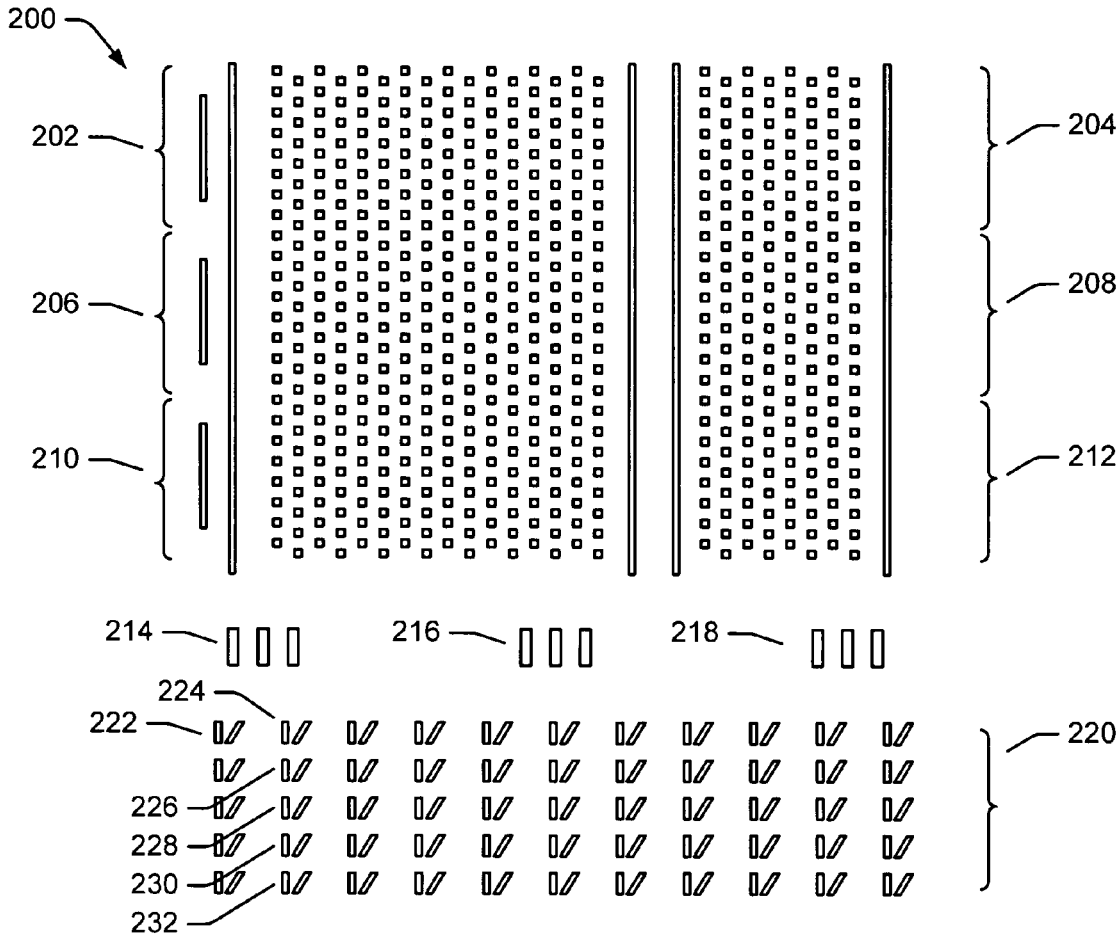
FIG. 2 is a diagram showing an example of a print alignment pattern.
Figure 3:
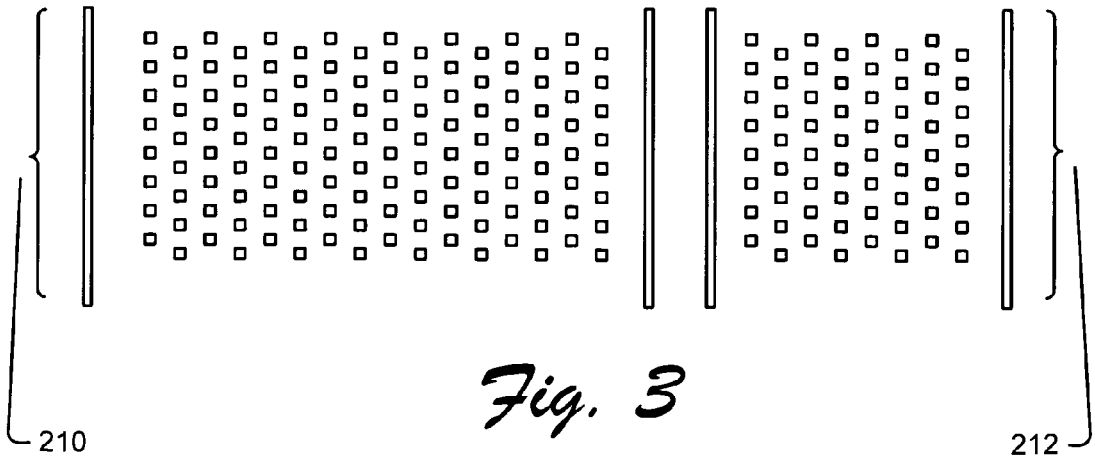
FIG. 3 is an enlarged view of a portion of the diagram of FIG. 2, showing in greater detail elements representing patches of light cyan and light magenta ink that have been printed using an ink density greater than that used for cyan and magenta inks.

Referring to FIG. 2, a diagram 200 shows, in monochrome, some of the characteristics of a print alignment pattern 106. In particular, the diagram 200 shows representations 202-212 of patches of black, yellow, cyan, magenta, light cyan and light magenta ink, respectively. The light cyan and light magenta patches 210, 212 are seen in greater detail in FIG. 3. Light cyan patches 210 and light magenta patches 212 are printed by light cyan and light magenta pens, respectively. The availability of light cyan and light magenta pens, in addition to cyan and magenta, yellow and black pens, provides greater image quality. Use of data obtained by scanning the patches 202-212 provides information usable by algorithms configured to compensate for scan-axis pen alignment errors. For example, the relative locations of each of the patches of each color and other information obtained by scanning the print alignment pattern can be used to perform any needed correction to any of the pens.

An important feature of the diagram 200 is that the density of the ink used to print the different colors of ink may be varied according to color. That is, a pen having ink of a first color of ink may print patches having an ink density that is different from the ink density of patches printed by a second pen having ink of a second color. For example, the light cyan ink pen and the light magenta ink pen may print patches 210, 212 having three times the ink density of the patches 206, 208 printed by pens having cyan and magenta ink. The greater ink density of the light cyan and light magenta ink patches 210, 212 increases the signal-to-noise ratio of the signal from the sensor 110 (FIG. 1) scanning the print alignment pattern 106 on which the patches are printed.

Continuing to refer to FIG. 2, cyan 214, black 216 and magenta 218 bars are provided. By scanning the bars 214-218, a current level to be sent to LEDs illuminating the print alignment pattern during scanning can be set. Adjustment of the current level to be sent to the LEDs calibrates the LEDs to the print alignment pattern, thereby enhancing the response to scanning by the sensor.

A region 220 of V-shaped markings is configured to provide paper axis (i.e. the axis of the media path through the printer) compensation for the pen alignment errors. Black 222, cyan 224, light cyan 226, magenta 228, light magenta 230 and yellow 232 V-shaped elements are included in the example of FIG. 2.

Returning to FIG. 1, an alignment pattern scanner 108 is configured to scan the print alignment pattern 106, typically communicating with various elements of the printer, as appropriate. In particular, the alignment pattern scanner 108 is configured interpret a signal from an optical sensor 110, which rides on the carriage, thereby allowing the sensor 110 to scan the print alignment pattern.

A pen alignment module 112 is configured to align the pens 103 within the printer 100. A typical embodiment of the pen alignment module 112 includes one or more algorithms to compare actual data obtained from scanning the alignment pattern as printed (with possible image quality problems due to pen alignment errors) to theoretical data representing scanning of a correctly printed alignment pattern. Accordingly, the pen alignment module 112 is typically configured to communicate with the alignment pattern scanner 108, and to obtain data from the optical sensor 110. Having compared actual to theoretical data, the algorithm may then calculate a mapping by which initial error compensation parameters associated with the pens of the printer are altered to result in the desired or corrected error compensation parameters. Generally, error compensation parameters compensate for discrepancies between the expected result of data sent to control inkjet printhead nozzle firings and the actual result of such data. Thus, where such discrepancies are known, error compensation parameters adjust data sent to the inkjet printhead nozzles to result in the expected output.

Figure 4:
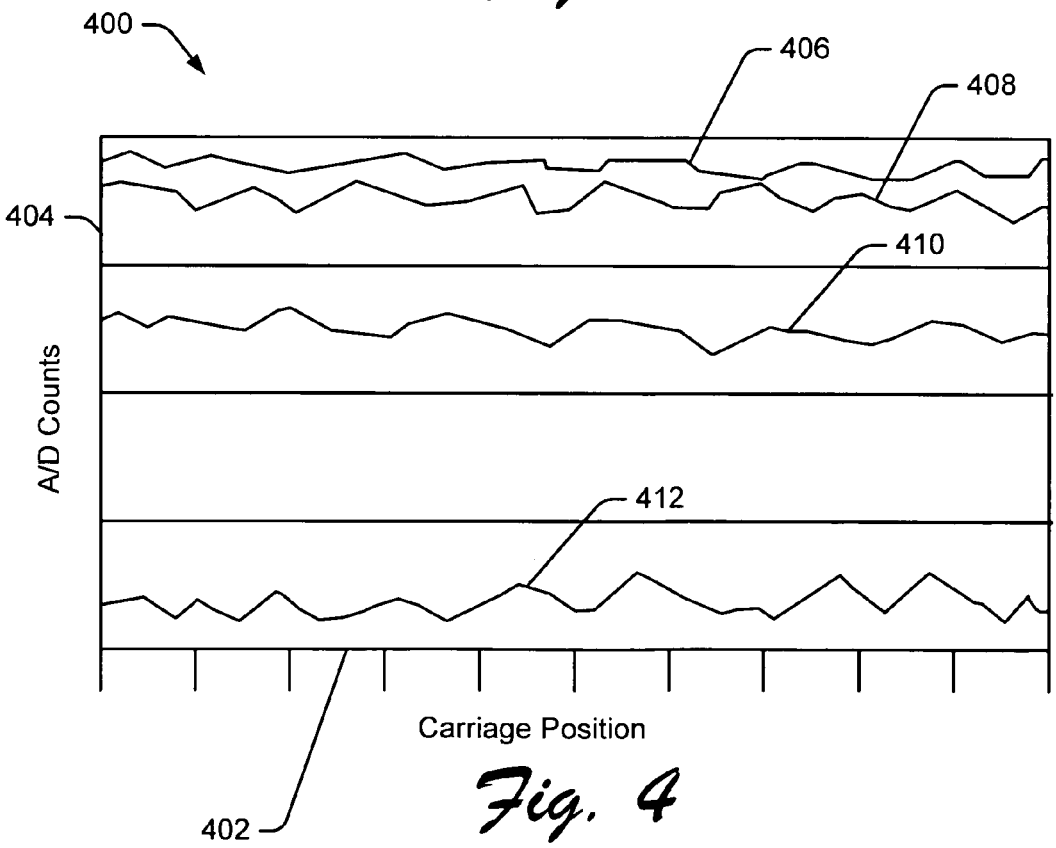
FIG. 4 is a graph that illustrates an exemplary contrast in background noise associated with different types of print media.

FIG. 4 is a graph 400 that illustrates an exemplary contrast in background noise associated with different types of print media, examples of four of which are shown. Background noise is important because it decreases the signal-to-noise ratio of the sensor 110 (FIG. 1) scanning a print alignment pattern printed on the media. In the graph 400, the horizontal axis 402 represents the position of the carriage, as it moves the pens of the printer left and right during the printing process. The left side of graph 400 represents measurements taken while the carriage is on the left side of the carriage rod, while the right side of graph 400 represents measurements taken while the carriage is on the right side of the carriage rod. The vertical axis 404 represents A/D (analog to digital) counts. A larger number of counts indicates a darker, noisier or grayer paper. Thus, two examples 406, 408 of print media are particularly bad, while the graph 410 of a third paper is significantly improved. A fourth type of media 412 is substantially "whiter," and therefore has less background noise. Accordingly, graph 400 illustrates examples 406-412 of four types of print media, wherein the examples are representative of available print media on which print media patterns may be printed.

Figure 5:
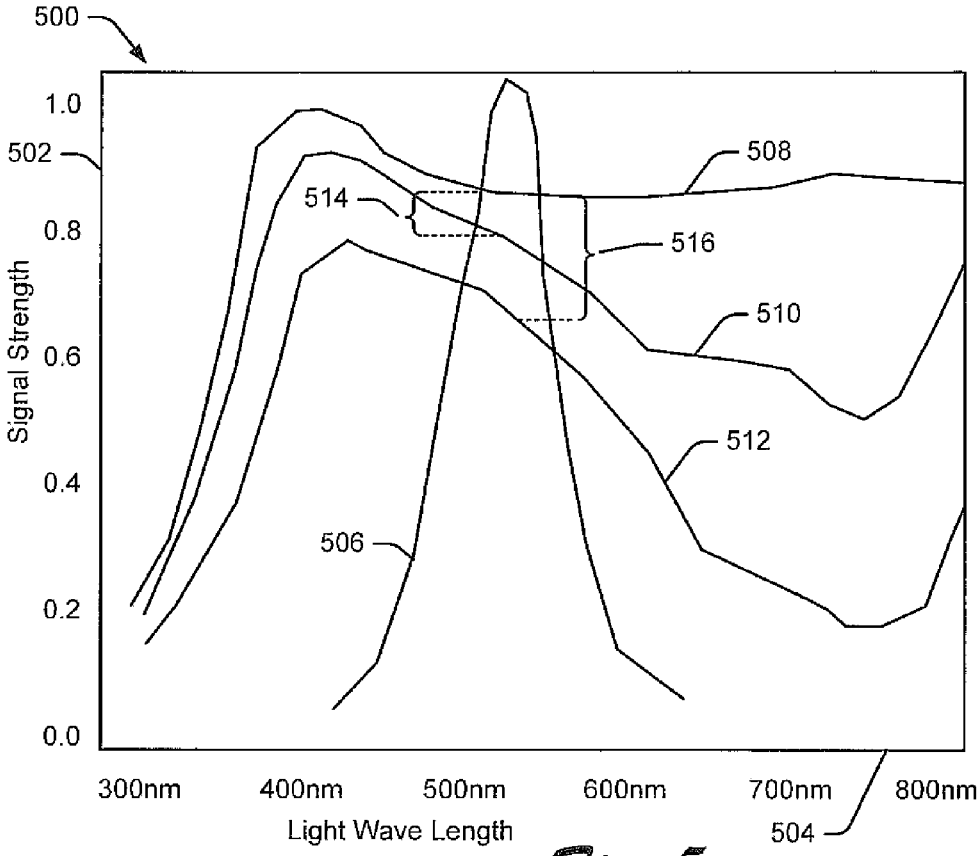
FIG. 5 is a graph showing signal strength vs. light frequency, wherein background noise and signal strength associated with two ink densities are shown.

FIG. 5 shows a graph 500 depicting the strength of a sensor signal scanning a print alignment pattern vs. the light frequency with which the print alignment pattern is illuminated. The vertical axis 502 shows strength of a signal from the sensor 110 (FIG. 1) scanning the print alignment pattern, while the horizontal axis 504 shows light frequency ranging from blues to reds with which the print alignment pattern is illuminated. In particular, the vertical axis 502 is scaled as a normalized value of the signal-to-noise ratio of a sensor 110

(FIG. 1) scanning a print alignment pattern 106 (FIG. 1). The horizontal axis 504 reflects the spectrum of light which may be obtained by using available LED(s) which may be selected to illuminate the print alignment pattern. As an example of the illumination that may be applied to the print alignment pattern, the spectrum 506 of a green LED is graphed in a middle region of the available spectrum.

The graph 500 of FIG. 5 includes three plots obtained while scanning with a green LED to illuminate a print alignment pattern. In particular, a first plot 508 shows background noise (i.e. scanning blank, unprinted paper). Second and third plots 510, 512 show signal strength associated when the sensor 110 (FIG. 1) scans lower and higher densities, respectively, of light cyan ink printed on a print alignment pattern 106 (FIG. 1). Also plotted is a spectral region 506 associated with a green LED, shown as an example of one optional illuminator of the print alignment pattern.

Plot 508 was obtained by scanning white paper with no ink under light of different frequencies. Note that the plot 508 is therefore "background noise." In contrast, plot 510 was obtained by scanning light cyan ink deposited at a density of "1×", i.e. standard ink densities, under light of different frequencies. For example, 1× ink could be 0.5 dot at 600 dpi (dots per inch). As seen in the graph 500, plot 510 is distinguishable from the background noise of plot 508. The degree to which plot 510 can be distinguished from the background noise, within the green spectrum, is shown by distance 514. In still further contrast, plot 512 was obtained by scanning light cyan ink deposited at a density of "3×", i.e. three times more ink than is standard, under light of different frequencies. For example, 3× ink could be 1.5 dot at 600 dpi (dots per inch). As seen in the graph 500, plot 512 reflects a significant improvement over the plot 510, in that plot 512 is more easily distinguished from background noise 508 than is plot 510. The improvement of plot 512 over plot 510, within the green spectrum, is shown by comparing the distances 514 and 516.

Within the spectrum of the green LED 506, the lower ink density signal-to-noise ratio 510 is separated from the background noise 508 by a distance 514. In contrast, the higher ink density signal-to-noise ratio 512 is separated from the background noise 508 by a significantly greater distance 516. Thus, within the spectrum of the green LED 506, there is a significant advantage to the signal-to-noise ratio where the density of the light cyan ink is increased.

Figure 6:
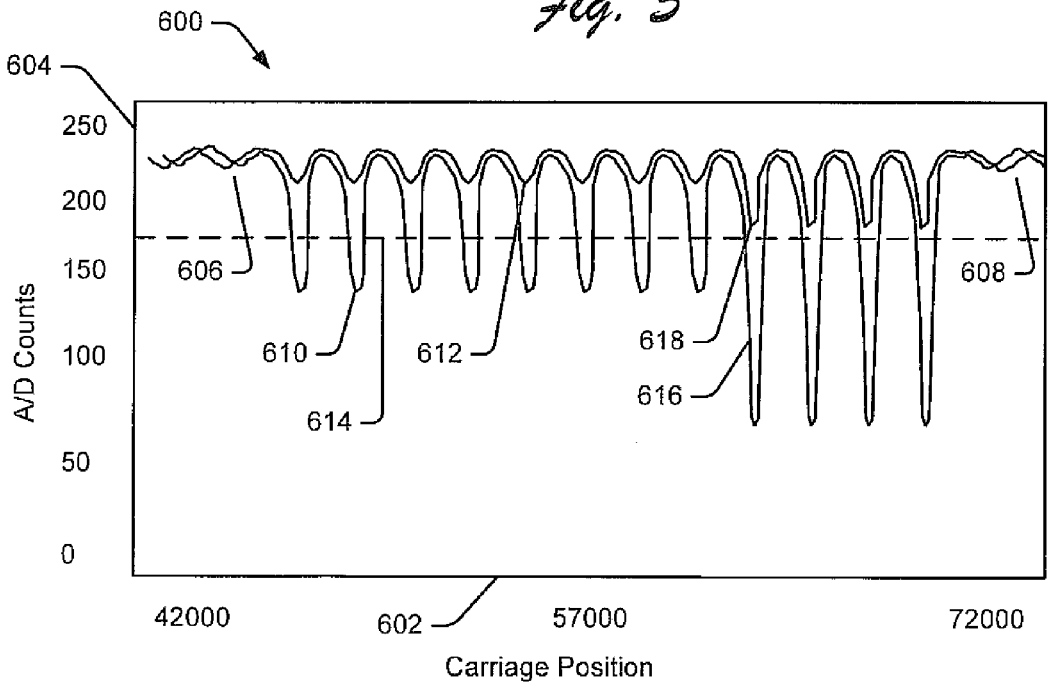
FIG. 6 is a graph showing two superimposed plots, each plot showing signal strength vs. carriage position for two ink colors as the carriage moves over and scans patches printed in cyan (left) and magenta (right).

FIG. 6 is a graph 600 showing signal strength vs. carriage position for two ink densities as the carriage moves over patches printed in cyan (left) and magenta (right) within a print alignment pattern. The horizontal axis 602 of the graph shows an example of a portion of the movement of the carriage numbered according to dot position, from 42,000 to 72,000 dots, on a 600 dpi scale. The vertical axis 604 shows A/D (analog to digital) counts. The scale, 0 to 255 counts (8-bit), is based on representative data from a representative sensor and print density. Regions 606 and 608 represent areas wherein there is no ink on the media; accordingly, data 606 and 608 represents background noise from the media. Spikes 610 represent sensor input taken from reading a patch of light cyan ink printed at 3× (i.e. three times the ink density of usual printing). Spikes 612 represent a superimposed graph of a sensor reading a patch of light cyan ink printed at 1× (i.e. the ink density of usual printing). Significantly, spike 610 exceeds a threshold 614, while spike 612 does not. The threshold 614 provides a somewhat arbitrary break between signal levels that are easily distinguished from the noise 606, 608 and signals having too low a signal-to-noise ratio to be reliably interpreted. Similarly, spikes 616 represent sensor input taken from reading a patch of light magenta ink printed at 3×. Spikes 618 represent a superimposed graph of a sensor reading a patch of light magenta ink printed at 1×. Similarly, it is significant that spike 616 exceeds the threshold 614, thereby indicating an adequate signal-to-noise ratio, while spike 618 does not. It is also noteworthy that spikes 616, 618 tend to be larger than spikes 610, 612. Their larger size may be attributed to factors such as the greater reflectivity of light magenta ink under the given lighting conditions (e.g. lighting color) as compared to the lower reflectivity levels of light cyan ink under those lighting conditions. Thus, FIG. 6 shows that by printing light cyan and light magenta ink patches on a print alignment pattern using (approximately) three times the ink, the signal-to-noise ratio of a scanning sensor (110, FIG. 1) is increased over printing the signal-to-noise ratio found using light cyan and light magenta ink printed a 1×.

Figure 7:
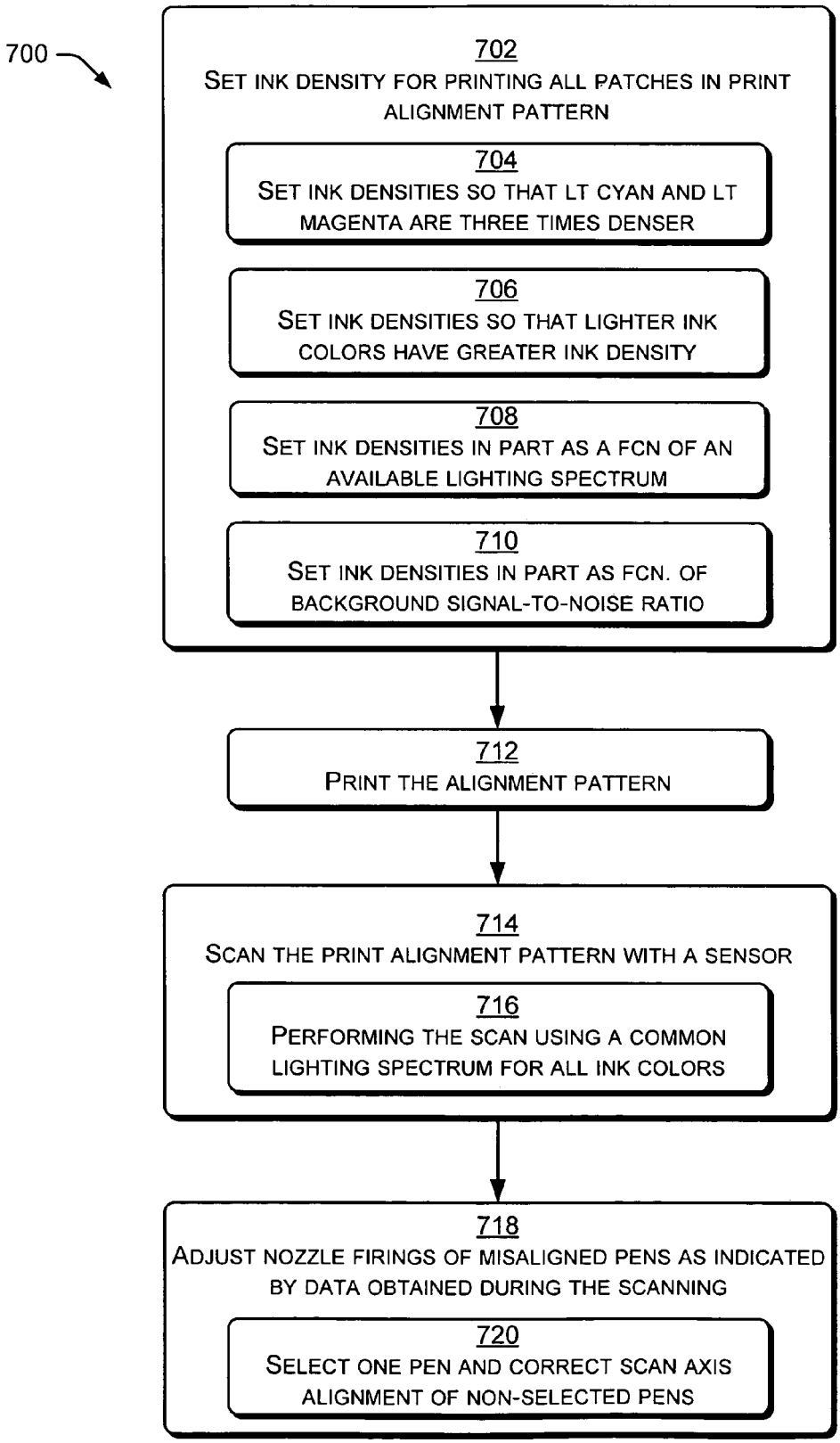
FIG. 7 is a flow chart showing an example of managing a signal-to-noise ratio of a signal produced by a sensor by controlling ink density within a print alignment pattern used for aligning pens within a printer.

FIG. 7 is a flow chart 700 showing an example of by which a printer may be operated so that a signal-to-noise ratio of a signal produced by a sensor 110 may be managed by controlling ink density within a print alignment pattern 106 used for aligning pens within a printer. Accordingly, ink density may be selected and managed as a function of the signal-to-noise ratio of the sensor, thereby maintaining a desirable signal-to-noise ratio by careful selection of ink densities.

At block 702, ink density for printing patches of each color in the print alignment pattern 106 is set and/or adjusted. By setting the ink densities for each color, the signal-to-noise ratio of the signal from the sensor 110 can be better controlled. In particular, the ink densities for light ink colors, such as light cyan and light magenta, are set. The setting of the ink densities for printing patches within the print alignment pattern 106 may be performed in a number of ways, four of which are listed here, and others of which are seen within other locations of this specification. In a first alternative, at block 704, ink densities are set so that light cyan ink and light magenta ink are three times denser (i.e. three times more ink per unit area) than cyan ink and magenta ink. In one example, the print alignment generator 104 is configured to make the settings described in blocks 704-710.

In a second alternative, at block 706, lighter ink colors are set to higher ink densities and darker ink colors are set to lower ink densities. For example, light cyan and light magenta inks may be printed with densities that are greater than those used for cyan and magenta ink.

In a third alternative, at block 708, ink densities are set in part as a function of an available lighting spectrum. For example, knowing the color of the LED illuminating the print alignment pattern may, in part, determine the best choice (or disclose which choices are adequate) for ink density of each color of ink. For example, during the scanning process wherein the sensor 110 of the alignment pattern scanner 108 is run over the print alignment pattern 106, the print alignment pattern will be illuminated, typically by an LED whose discharge is a known color. FIG. 5 shows an example wherein a green LED is used to provide illumination (see the region under curve 506). By comparing the signal detection of two or more ink densities (e.g. 510, 512) under the given illumination, e.g. the green spectra 506, an ink density which produces a signal having a signal-to-noise ratio that adequately distinguishes the background noise 508 can be selected. Generally, this can be done by comparing the distances of the curves associated with two or more ink densities, e.g. curves 510 and 512, from the curve 508 representing the background noise. An ink density that is sufficiently distinguished from the background noise 508 is then selected. Accordingly, the ink density selected for any ink color may therefore be indicated, in part, by the color of the available lighting.

In a fourth alternative, seen at block 710, ink densities are set in part as a function of the background signal-to-noise ratio. For example, if the print media is of poor quality, there may be lots of background noise (e.g. see curve 406 in FIG. 4). Accordingly, a higher ink density (more ink per unit area) may be required to achieve a desirable signal-to-noise ratio on the sensor 110. Alternatively, if the background noise is minimal, then a lower ink density may be sufficient for use in printing patches in a print alignment pattern 106.

At block 712 an alignment pattern is printed. For example, an alignment pattern 106 (FIG. 1) having some or all of the characteristics of the alignment pattern diagram 200 (FIG. 2) may be printed by a print mechanism 102 at the direction of the alignment pattern generator 104 of a printer 100.

At block 714, the print alignment pattern is scanned. This may be done in a number of ways. For example, a sensor 110 of an alignment pattern scanner 108 may be used to scan a print alignment pattern 106. In one implementation, seen at block 716, the scan may be performed using a common lighting spectrum for all ink colors, i.e. one color of LED may be used while all colors printed on the print alignment pattern are scanned.

At block 718, nozzle firings of misaligned pens are adjusted as indicated by data obtained during the scanning. This adjustment may be performed by the pen alignment module 112 of FIG. 1. For example, where six pens are present, cyan, light cyan, magenta, light magenta, yellow and black, alignment of the pens may be needed to cause ink applied to the media by one pen to be correctly located with respect to ink applied to the media by other pens. This may be performed in a number of ways, such as at block 720, wherein one pen is selected and the scan axis alignment of the non-selected pens are corrected to conform to the selected pen. For example, if the black pen is selected, the other pens may be corrected so that ink applied to the media by them is correctly located with respect to ink applied to the media from the black pen. This correction may be made by use of an algorithm configured to compare data obtained from scanning the alignment pattern as printed (with possible image quality problems due to pen alignment errors) to theoretical data representing scanning of a correctly printed alignment pattern. Having made the comparison, the algorithm may then calculate a mapping by which initial error compensation parameters associated with the pens of the printer are altered to result in the desired or corrected error compensation parameters.

Although the above disclosure has been described in language specific to structural features and/or methodological steps, it is to be understood that the appended claims are not limited to the specific features or steps described. Rather, the specific features and steps are exemplary forms of implementing this disclosure. For example, while actions described in blocks of the flow diagrams may be performed in parallel with actions described in other blocks, the actions may occur in an alternate order, or may be distributed in a manner which associates actions with more than one other block. And further, while elements of the methods disclosed are intended to be performed in any desired manner, it is anticipated that computer- or processor-readable instructions, performed by a computer and/or processor, typically located within a printer, reading from a computer- or processor-readable media, such as a ROM, disk or CD ROM, would be preferred, but that an application specific gate array (ASIC) or similar hardware structure, could be substituted.

The invention claimed is:

1. One or more processor-readable media on which are defined processor-executable instructions for managing a signal-to-noise ratio of a signal produced by a sensor by controlling ink density within a print test pattern scanned by the sensor, the processor-executable instructions comprising instructions for:

setting an ink density with which each of two or more pens prints, wherein for each pen, ink density is set as a function of the signal-to-noise ratio of the signal of the sensor, so that the signal-to-noise ratio exceeds a threshold;

configuring the print test pattern as a print alignment pattern;

printing the print test pattern, wherein the print test pattern comprises patches printed by each of the two or more pens according to the ink density set for that pen;

scanning the print test pattern with the sensor, thereby producing the signal having a signal-to-noise ratio exceeding the threshold; and adjusting nozzle firings of misaligned pens as indicated by data obtained during the scanning.

2. The one or more processor-readable media of claim 1, wherein setting the ink density comprises instructions for setting ink density in part as a function of background signal-to-noise inherent with print media upon which the print test pattern is printed.

3. The one or more processor-readable media of claim 1, wherein setting the ink density comprises instructions for using greater ink densities when printing patches using inks of lighter colors and for using lesser ink densities when printing patches using inks of darker colors.

4. The one or more processor-readable media of claim 1, wherein setting the ink density comprises instructions for setting ink densities used for each patch of light cyan ink and light magenta ink approximately three times higher than ink densities used for cyan ink and magenta ink, respectively.

5. The one or more processor-readable media of claim 1, wherein setting the ink density comprises instructions for setting ink densities in part as a function of an available lighting spectrum.

6. The one or more processor-readable media of claim 1, wherein scanning the print test pattern comprises instructions which result in operation of a common lighting spectrum that is used to scan ink patches of all colors associated with each of the two or more pens.

7. The one or more processor-readable media of claim 1, wherein adjusting nozzle firings comprises instructions for:

selecting one pen and correcting scan axis alignment of non-selected pens according to the selected pen using the data obtained during the scanning.

8. A method for managing a signal-to-noise ratio of a signal produced by a sensor by controlling ink density within a print alignment pattern used for aligning pens within a printer, the method comprising:

setting ink densities with which to print at least two ink colors, wherein each ink density used is a function of the signal-to-noise ratio of the signal of the sensor;

printing the print alignment pattern according to the set ink densities, wherein the print alignment pattern comprises patches of the at least two ink colors in at least two ink densities;

scanning the print alignment pattern with the sensor, thereby obtaining data indicating performance of each of the pens; and adjusting nozzle firings of misaligned pens as indicated by the data obtained during the scanning.

9. The method of claim 8, wherein setting ink densities comprises keeping the signal-to-noise ratio of a signal from the sensor above a threshold required for reliable data recovery from the signal.

10. The method of claim 8, wherein printing the print alignment pattern comprises using greater ink densities when printing patches using inks of lighter colors and for using lesser ink densities when printing patches using inks of darker colors.

11. The method of claim 8, wherein the printing comprises patches printed using light cyan ink and light magenta ink have an ink density that is approximately three times higher than ink densities used to print patches using cyan ink and magenta ink, respectively.

12. The method of claim 8, wherein the ink densities are set in part as a function of an available lighting spectrum.

13. The method of claim 8, wherein scanning the print alignment pattern comprises controlling an LED to provide a lighting spectrum that is used in common to scan ink patches of each of the at least two colors.

14. The method of claim 8, wherein adjusting nozzle firings comprises selecting one pen and correcting scan axis alignment of non-selected pens by adjusting their nozzle firings using the data obtained during the scanning.

15. A printer configured for managing a signal-to-noise ratio of a signal produced by a sensor by controlling ink density within a print alignment pattern used for aligning pens within a printer, comprising:

means for setting an ink density with which to print each of at least two ink colors, wherein each ink density used is set to result in the signal-to-noise ratio of the signal of the sensor exceeding a threshold during scanning, wherein the means for setting the ink density sets ink densities in part as a function of background signal-to-noise inherent with print media upon which the print alignment pattern is printed;

means for printing the print alignment pattern, wherein the print alignment pattern comprises patches of the at least two ink colors;

means for scanning the print alignment pattern with the sensor; and means for adjusting nozzle firings of misaligned pens as indicated by data obtained by the means for scanning.

16. The printer of claim 15, wherein the means for setting the ink density uses greater ink densities when printing a lighter shade of a color and uses lesser ink densities when printing a darker shade of the color.

17. The printer of claim 15, wherein the means for setting the ink density sets ink densities used for each patch of light cyan ink and light magenta ink approximately three times higher than ink densities used for cyan ink and magenta ink, respectively.

18. The printer of claim 15, wherein the means for adjusting nozzle firings selects one pen and corrects scan axis alignment of non-selected pens according to the selected pen using the data obtained by the means for scanning.

19. A printer configured for managing a signal-to-noise ratio of a signal produced by a sensor by controlling ink density within a print alignment pattern used for aligning pens within a printer, the printer comprising:

an alignment pattern generator configured to set an ink density with which each of at least two ink colors is printed, wherein each ink density used is set as a function of the signal-to-noise ratio of the signal of the sensor so that the sensor exceeds a threshold during scanning, and wherein some of the at least two ink colors are printed at a different density, and each of the at least two ink colors is printed at a uniform density;

a print mechanism configured to print the print alignment pattern, wherein the print alignment pattern comprises patches using the at least two ink colors;

an alignment pattern scanner configured to scan the print alignment pattern with the sensor; and a pen alignment module configured to adjust nozzle firings of misaligned pens as indicated by data obtained by the alignment pattern scanner.

20. The printer of claim 19, wherein the alignment pattern generator is additionally configured to set the ink density in part as a function of background signal-to-noise inherent with print media upon which the print alignment pattern is printed.

21. The printer of claim 19, wherein the alignment pattern generator is additionally configured for setting ink densities used for each patch of light cyan ink and light magenta ink approximately three times higher than ink densities used for cyan ink and magenta ink, respectively.

22. The printer of claim 19, wherein the alignment pattern generator is additionally configured for setting ink densities in part as a function of an available lighting spectrum.

23. The printer of claim 19, wherein the pen alignment module is additionally configured for selecting one pen and correcting scan axis alignment of non-selected pens according to the selected pen using the data obtained during the scanning.

* * * * *